United States Patent [19]

Sommer et al.

[11] Patent Number: 4,807,559

[45] Date of Patent: Feb. 28, 1989

[54] APPARATUS FOR ALLOYING OF COATINGS

[75] Inventors: Richard A. Sommer, Warren; George Havas, Youngstown; Mario Tama, Cortland, all of Ohio; Clayton H. Allen, Chebeague Island, Me.

[73] Assignee: Ajax Magnethermic Corporation, Warren, Ohio

[21] Appl. No.: 92,181

[22] Filed: Sep. 2, 1987

[51] Int. Cl.[4] ..... B05C 11/00

[52] U.S. Cl. ..... 118/63; 118/67; 118/419; 118/426; 118/620

[58] Field of Search ..... 118/63, 67, 419, 426, 118/620

[56] References Cited

U.S. PATENT DOCUMENTS

| | | | |
|---|---|---|---|
| 2,647,305 | 8/1953 | Cook et al. | 29/196.2 |
| 3,190,768 | 6/1965 | Wright | 427/46 |
| 3,307,968 | 3/1967 | Schnedler | 117/114 |
| 3,758,333 | 9/1973 | Herman | 117/62 |

FOREIGN PATENT DOCUMENTS 5248342 2/1974 Japan .

OTHER PUBLICATIONS

*Radio Amateur's Handbook*, 36th Ed. (1959) pp. 323–330.

*Primary Examiner*—Bernard Pianalto

*Attorney, Agent, or Firm*—Fay, Sharpe, Beall, Fagan, Minnich & McKee

[57] ABSTRACT

A method and apparatus particularly adapted for alloying a coating on a steel strip. The invention uses an induction heating furnace to produce a galvannealed product. In particular, the operating frequency to the heating coils of the furnace is modulated to avoid a resonant vibration in the steel strip through the heating zone of the furnace. Preferably the invention comprises imposing a frequency modulation on the operating frequency of the power signal to the heating coils.

6 Claims, 1 Drawing Sheet

FIG. 1
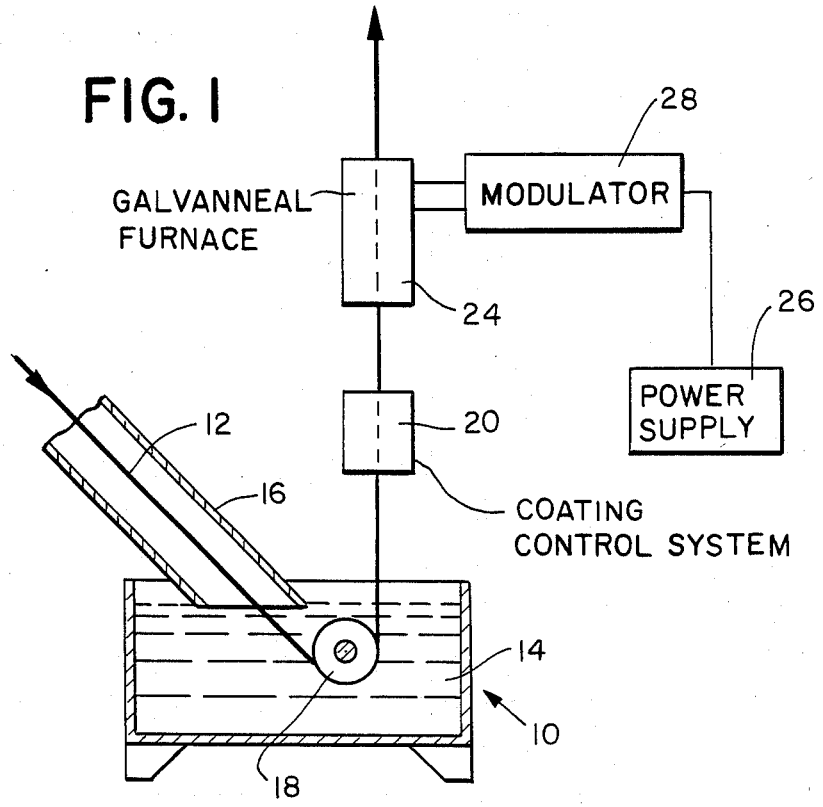
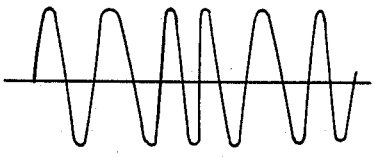
FIG. 2

APPARATUS FOR ALLOYING OF COATINGS

BACKGROUND OF THE INVENTION

This invention pertains to the art of induction heating and more particularly to a method and apparatus for alloying a coating to an item with induction heating techniques.

The invention is particularly applicable to a method and apparatus for applying a zinc coating to a strip steel product that is typically employed in the manufacture of automobiles. However, it will be appreciated to those skilled in the art that the invention could be readily adapted for use in other areas of application is, for example, where other coatings are employed to protect other types of items.

The process of galvanizing, or the coating of iron or steel products with rust-resistant zinc, is well known. Galvannealing is also well known and provides the advantage of producing a coating which is comprised of iron-zinc alloy phases, in contrast to the essentially pure zinc coating provided on galvanized steel. A galvannealed product has a number of advantages over a galvanized product and in particular is easier to spot weld and has better paintability. Hence, galvannealed steel is more valuable to the automobile manufacturing industry.

The galvannealing process essentially consists of submerging a clean, preheated steel strip in a bath of liquid zinc. As the strip emerges from the bath, it passes through a coating control system, such as an air knife, which is used to control the thickness of the coating. The coated strip is then reheated in a galvannealing furnace to produce further intermetallic diffussion between the zinc and the steel substrate. A galvannealing furnace is typically fuel fired, but it is also known that the heating may be done electrically by induction heating coils. After exiting from the furnace the strip is allowed to cool.

There are at least two types of galvannealed products: one has equal coating on either surface of the strip, the other is described as "AB product" and has a different coating weight on each surface controlled by adjustment of the air knife. In an AB product essentially all the free zinc is removed from one surface while the other surface has various coating weights remaining.

A particular problem which has been encountered in the industry with the galvannealing installations that employ induction heating coils is the occurrence of lines or strips in the coated steel product. The stripes appearing in the finished product are typically parallel to the direction of movement of the strip through the furnace. Occurrence of the stripes is coincident with an audible noise so that the characteristic has been referred to as "noise stripes." The stripes are actually evidence of a resonant response in the strip to the induction heating field of the induction heating coils. It has been experimentally established that as the temperature of the coated steel strip rises in the furnace, its changing characteristics may at least somewhere along the length of the heating zone produce the proper conditions for resonant vibration in the strip. This resonant vibration causes the formation of stripes in the work product. The vibration results in a non-uniform surface in the finished product making it unacceptable as a high quality commercial product.

The galvannealing process requires precise control of many variables to produce a satisfactory product. Some of which are strip temperature, speed and tension; bath temperature and composition; coating control; heating; and cooling.

When the heating was performed by induction heating techniques an additional variable was added, operating frequency. Even though induction heating provided improved control over the heating, it disappointingly also caused the noise stripe problem. Surprisingly, mere tuning or adjustment of the operating frequency failed to avoid the noise line problem. Even more surprisingly, further adjustment of the other variables also failed to eliminate the problem.

The noise stripes have been more technically identified as resulting from transverse flexural resonance in the steel strip. The term originates from a vibrational flexing in the strip transverse to its direction of movement set up by an occurrence of the resonant vibration in the strip.

When the inventors identified the problem as transvere flexural resonance in the strip, they realized that mere adjustment of the operating frequency could not avoid the problem because the continuously varying characteristics of the strip through the heating zone could establish the conditions so that resonance would be satisfied at some point.

The present invention contemplates a new and improved method and apparatus which overcomes the above-referred to problems and others to provide a new method and apparatus which is simple in design, readily adaptable to a plurality of uses with a variety of items having a variety of dimensional characteristics, and which precludes the production of noise stripes in a galvannealed product.

BRIEF SUMMARY OF THE INVENTION

In accordance with the present invention, there is provided a method and apparatus particularly suited for producing a galvannealed AB product such as may be employed in the manufacture of automobiles. The method comprises a series of steps, the first of which is applying a coating to an item such as a strip of prepared steel. Typically the coating is applied by passing the strip through a molten bath although other ways of applying coating are certainly within the scope of the invention. Secondly, the thickness of the coating is selectively controlled with a coating control system. Such a system is typically an air knife which controls the thickness of the coating on the strip. Thirdly, the strip is passed through an induction heating coil for alloying of the coating to the strip. Fourthly, the operating frequency of the coil is modulated to preclude the production of any transverse flexural resonance in the strip by continually varying the frequency applied to the induction heating coil. The modulation is preferably a frequency modulation of the operating frequency but is within the scope of the invention to modulate the operating frequency in other ways, for example, such as by phase modulation. The modulation of the operating frequency avoids transverse flexural resonance in the strip and the noise lines associated therewith.

In accordance with another aspect of the present invention, the modulating comprises inserting a frequency modulation on the induction heating coil operating frequency.

In accordance with a more limited aspect of the present invention, the phase modulation is electronically produced within the power supply to the induction heating coils.

In accordance with another more limited aspect of the present invention, a frequency modulation is accomplished by using variable components as a part of a resonating load circuit in operative connection to the heating coils.

A benefit obtained by use of the present invention is an improved galvannealed product produced with induction heating techniques.

Another benefit obtained from the present invention is a galvannealed product produced without noise lines.

Other benefits and advantages for the subject new method and apparatus will become apparent to those skilled in the art upon a reading and understanding of this specification.

BRIEF DESCRIPTION OF THE DRAWINGS

The invention may take physical form in certain parts and arrangements of parts, and in certain steps and arrangements of steps, the preferred embodiments of which will be described in detail in this specification and illustrated in the accompanying drawings which form a part hereof and wherein:

FIG. 1 is a schematic representation of a galvannealing process and apparatus formed in accordance with the present invention; and, FIG. 2 is a graphical representation of a modulated operating frequency such as may be employed in a heating oil of an induction heating galvannealing furnace by a power supply. The modulation is exaggerated for purposes of illustration.

DETAILED DESCRIPTION OF THE INVENTION

Referring now to the drawings wherein the showings are for purposes of illustrating preferred embodiments of the invention only and not limitations thereof, the FIGURES show a galvannealing system assembly 10 wherein a clean, preheated steel strip 12 is submerged in a coating bath 14 essentially comprised of liquid zinc. The strip 12 is directed to the bath 14 through a snout 16 and about a guide wheel 18. After emerging from the bath 14, the coated strip is directed to a coating control system 20, conventionally comprising an airknife for selectively controlling the thickness of the coating on the strip. In the preferred embodiment the strip emerging from the coating control system 20 is an AB Product in which the coating has been somewhat allowed to the strip in a manner consistent with conventional galvanizing processes. Subsequent to emerging from the coating control system, the strip is passed through a galvanneal furnace 24 to further alloy the coating with the strip material as a result of the additional time the strip spends at the elevated temperature.

The subject invention includes a galvanneal furnace comprising an induction heating coil assembly (not shown). Such coils and the techniques of their operation are well known in the art and need not be described here. It is a feature of an induction heating coil in a galvannealing furnace that improved control of temperature in the strip is obtained and, accordingly, a better galvanneal product is formed.

An induction heating coil requires an alternating current power supply 26 and it is a feature of the invention that the operating frequency of the power supply signal is modulated by a modulator 28. Techniques for modulating an alternating current signal are well known in the art. It is within the scope of the invention to include frequency or phase modulation of the voltage applied to the induction heating coil to avoid establishing a transverse flexural resonance in the strip as it passes through the heating zone of the galvanneal furnace 24. By modulating the frequency of the voltage applied to the coil assembly, the operating conditions throughout the heating zone never stabilize and a resonant response is not produced in the strip. Accordingly, the noise line problem of prior known galvannealing furnaces is avoided.

With reference to FIG. 2, preferably the operating frequency of the power supply signal is modulated by imposing a narrow band frequency modulation on the operating frequency. A typical operating frequency for a galvanneal furnace is 9500 Hz. This type of modulation can be imposed by circuit means such as shown in FIG. 1 by block 28 to provide an oscillating load circuit. Typically such components will comprise variable inductors or capacitors. Such variable components can readily produce frequency modulation ($\pm 0.75\%$) on the operating frequency. Alternatively, the frequency modulation can be electronically produced within the power supply. Both have been successfully tested. Both techniques for modulating the operating signal are well within the expertise of one skilled in the art and are therefore not discussed in detail herein. Yet another technique for modulating the signal in the heating coils is phase modulation which is preferably accomplished electronically within the power supply. Such techniques are also well within the knowledge of one skilled in the art. For example, detailed circuit assemblies for accomplishing phase and frequency modulating are published within the *Radio Amateur's Handbook,* 36th Ed. (1959), pp. 323–330.

The invention has been described with reference to the preferred embodiments of method and apparatus. Obviously, modifications and alterations will occur to others upon the reading and understanding of the specification. It is our intention to include all such modifications and alterations in so far as they come within the scope of the appended claims or the equivalents thereof.

Having thus described our invention, we now claim:

1. An assembly for galvannealing steel strip comprising:

means for applying a coating to the steel strip;

means for controlling a thickness of the applied coating;

means for heating the steel and coating by magnetic induction to produce a galvannealed product, the heating means having a preselected operating frequency; and circuit means for imposing a frequency modulation on the operating frequency whereby undesirable transverse flexural resonance in the galvannealed product is avoided.

2. The assembly as claimed in claim 1 wherein the means for imposing the frequency modulation comprises an oscillating circuit including variable components.

3. The assembly as claimed in claim 2 wherein the components comprise a variable inductor.

4. The assembly as claimed in claim 2 wherein the components comprise a variable capacitor.

5. The assembly as claimed in claim 1 wherein the means for varying comprises modulating a power supply operating frequency.

6. The assembly as claimed in claim 1 wherein the means for varying the operating frequency comprises circuit means for imposing a phase modulation on the operating frequency.

* * * * *

UNITED STATES PATENT AND TRADEMARK OFFICE

CERTIFICATE OF CORRECTION

PATENT NO. : 4,807,559

DATED : February 28, 1989

INVENTOR(S) : Richard A. Sommer, et al.

It is certified that error appears in the above—identified patent and that said Letters Patent is hereby corrected as shown below:

At column 1, line 50, "strips" should be "stripes".

At column 3, line 29, "oil" should be "coil".

At column 3, line 48, "allowed" should be "alloyed".

Signed and Sealed this

Third Day of October, 1989

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,807,559

DATED : February 28, 1989

INVENTOR(S) : Richard A. Sommer, et al.

It is certified that error appears in the above-identified patent and that said Letters Patent is hereby corrected as shown below:

On the title page:

Assignees: Ajax Magnethermic Corporation,
Warren, Ohio (one-half interest)

National Steel Corporation,
Pittsburgh, Pennsylvania (part interest)

Signed and Sealed this

Twelfth Day of February, 1991

*Attest:*

HARRY F. MANBECK, JR.

*Attesting Officer*

*Commissioner of Patents and Trademarks*